United States Patent [19]

Huszczuk

[11] Patent Number: 4,647,036

[45] Date of Patent: Mar. 3, 1987

[54] ENERGY MEASUREMENT ENABLING APPARATUS

[75] Inventor: Andrew R. Huszczuk, Long Beach, Calif.

[73] Assignee: Harbor-UCLA Medical Center Research and Education Institute, Inc., Torrance, Calif.

[21] Appl. No.: 634,280

[22] Filed: Jul. 25, 1984

[51] Int. Cl.[4] ..... A63B 21/00; A63B 69/16; A61B 5/22

[52] U.S. Cl. ..... 272/73; 272/128; 73/379

[58] Field of Search ..... 272/73, 128; 73/379; 128/25 R; 310/74, 153

[56] References Cited

FOREIGN PATENT DOCUMENTS 0132504 5/1949 Australia ..... 272/73
2238585 2/1974 Fed. Rep. of Germany ..... 272/73

*Primary Examiner*—Robert A. Hafer
*Assistant Examiner*—Kathleen J. D'Arrigo
*Attorney, Agent, or Firm*—Drucker & Sommers

[57] ABSTRACT

A device for enabling testing of a person's physical condition, by enabling measurement of the energy expended by the person to be tested thereby, in manually maintaining rotation of a flywheel in a stationary bicycle, against resistance applied to the flywheel, for use in determining the efficiency of the person's body in using energy, as an indication of such person's physical condition.

The device is adapted to overcome inertia of the flywheel, from rest to a selected speed of rotation thereof, in an efficient and effective manner, prior to the onset of the test. Upon the onset of the test, with inertia in the flywheel having been non-manually overcome, the person to be tested is to manually maintain rotation of the flywheel, against resistance applied thereto, by manually rotating pedals operably connected to the flywheel.

The device includes a non-manual inertia overcoming mechanism. In one embodiment, the mechanism includes a motor, the drive shaft of which is rotatably mounted in the bicycle frame and operably connected, through sprockets and a chain, to a sprocket, driven by the motor drive shaft through such operable connections. The driven sprocket is engaged with a belt, which is operably connected to the flywheel, for selectively driving the belt and flywheel thereby.

In another embodiment, the mechanism includes a motor, the drive shaft of which is rotatably mounted in the bicycle frame, with the flywheel mounted thereon, for selectively and non-manually overcoming inertia in the flywheel.

4 Claims, 2 Drawing Figures

ENERGY MEASUREMENT ENABLING APPARATUS

BACKGROUND OF THE INVENTION

The invention relates generally to devices for enabling testing of the physical condition of a person. It relates specifically to such a device for enabling measurement of the energy expended by the person, in manually maintaining rotation of a flywheel in a stationary bicycle, against resistance applied to the flywheel, for use as an indication of the person's physcial condition.

It has been known to use a stationary bicycle, and to apply resistance to the flywheel in such bicycle, for the purpose of measuring the energy expended by a person, in generating rotation of the flywheel, by rotating pedals operably connected to the flywheel.

However, the very large amount of energy required initially to overcome inertia in the flywheel is very difficult to generate for many persons who need to be tested, including elderly and sick persons, and is very difficult to measure accurately. Once this energy is expended by the person being tested, it adversely affects the ability of such person to generate the further energy required for maintaining rotation of the flywheel, against resistance applied thereto, in the accurately-measureable range of operation thereof, adversely affecting the accuracy of the test results.

Further, presently known stationary bicycles, adapted to enable measurement of energy expended by a person, do not include a mechanism for overcoming the inertia of the flywheel and attaining non-manual rotation at a selected speed prior to the onset of the test, as a result of which such bicycles require complex calibration procedures in order to assess the magnitude of measurement errors, and impose an excessive exertion upon elderly, sick, or very young people.

SUMMARY OF THE INVENTION

The invention is adapted to overcome the above problems, as well as others, associated with the prior art. It provides an efficient and effective mechanism for overcoming inertia of the flywheel, from rest to a selected speed of rotation thereof, non-manually. The mechanism provides the energy required to overcome inertia of the flywheel, from rest to the selected speed of rotation thereof, non-manually and efficiently. Thereafter, the person to be tested having conserved such energy, which energy would otherwise be difficult to generate and difficult to accurately measure, is better able to generate the energy required to manually maintain rotation of the flywheel, against resistance applied in opposition to such rotation thereof, in an accurately-measurable range of operation of the device. The mechanism thereby enables accurate measurement of the energy expended by the person to be tested, for use in determining such person's physical condition.

The non-manual inertia overcoming mechanism, in one embodiment thereof, includes a motor, selectively operable, the drive shaft of which is rotatably mounted in the frame of the stationary bicycle. The motor drive shaft is operably connected, through sprockets and a chain, to a sprocket driven by the motor drive shaft through such operable connections. The driven sprocket is ganged with a further sprocket engaged with a belt. The belt is part of the operable connection to the flywheel, which is rotatably mounted at a spaced-apart location in the bicycle frame.

Upon selectively operating the motor, the motor drive shaft drives the further sprocket operably connected thereto. This in turn drives the belt engaged with the further sprocket, which in turn generates rotation of the flywheel operably connected thereto. Such operation continues at a selected speed of rotation of the flywheel until the onset of the test, at which the motor is selectively operated so as to be disconnected from the system, whereupon continued rotation of the flywheel, against an applied resistance, is manually generated by the person to be tested thereby.

The non-manual inertia overcoming mechanism, in another embodiment thereof, includes a motor, selectively operable, the drive shaft of which is rotatably mounted in the frame of the stationary bicycle, with the bicycle flywheel mounted thereon. The pedals, rotatably journalled in the bicycle frame at a location spaced from the flywheel, are operably connected to the flywheel.

Upon selectively operating the motor, the motor drive shaft drives the flywheel mounted thereon. Such initial operation continues at a selected speed of rotation of the flywheel until the onset of the test, at which the motor is selectively operated such that its mode of operation is switched from "propel" to "resist" rotation, whereupon continued rotation of the flywheel, against an applied resistance, is generated by the person to be tested thereby.

DETAILED DESCRIPTION OF THE INVENTION

Figure 1:
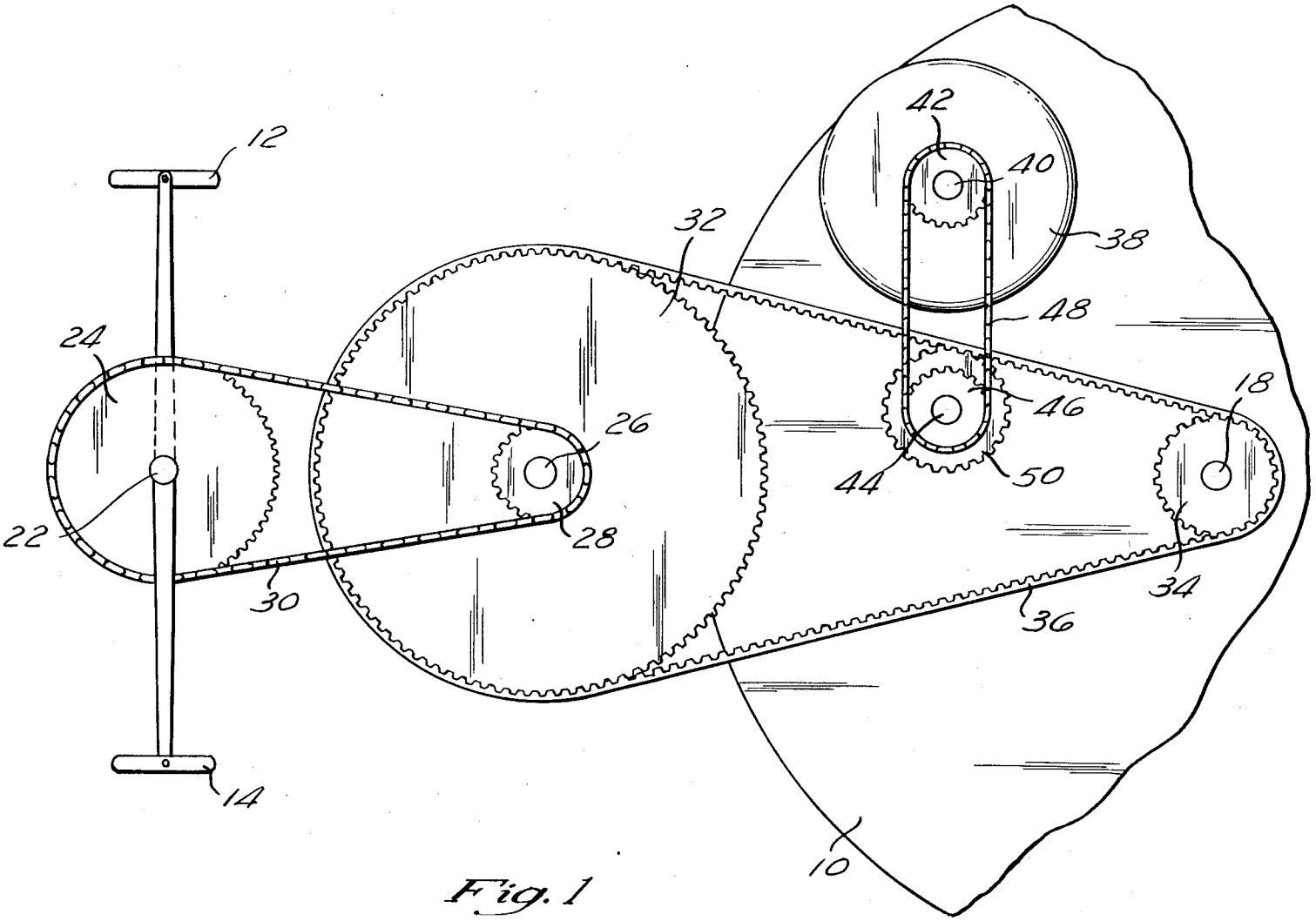
FIG. 1 is an elevational view of the pedals, flywheel, motor, and operable connections thereof, pursuant to one embodiment of the invention.
Figure 2:
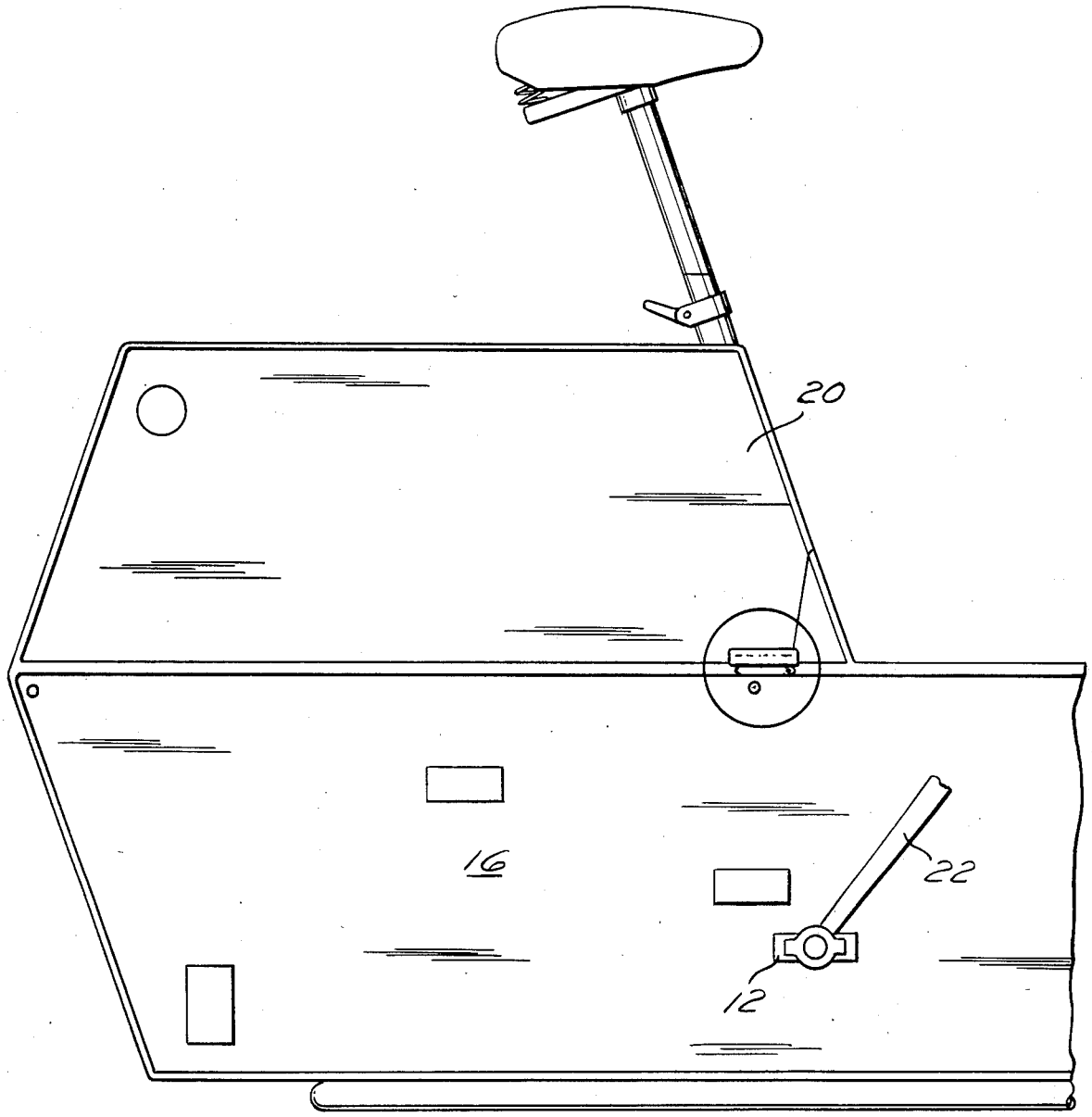
FIG. 2 is an elevational partly-fragmentary view of one embodiment of a stationary bicycle in which the device of the invention may be installed.

The invention, as shown in one embodiment thereof in FIGS. 1 and 2, and as described herein, comprises a device for enabling testing of a person's physical condition, by enabling measurement of energy expended by the person in manually maintaining rotation of a flywheel 10, to which pedals 12, 14 are operably connected, in a stationary bicycle 16, against resistance applied to flywheel 10. Flywheel 10 is mounted on hub 18, rotatably mounted in frame 20 in bicycle 16.

The device is adapted to overcome inertia of flywheel 10, from rest to a selected speed of rotation thereof, as for example 1000 revolutions per minute, non-manually, prior to the onset of the test. Such non-manual rotation of flywheel 10 continues for a period of time until the person is in a substantially steady-state condition, as for example for two to fifteen minutes, at which point the test is initiated, the non-manual inertia overcoming mechanism is disconnected, resistance is applied to flywheel 10, and the person to be tested is to manually maintain rotation of flywheel 10, against the resistance applied thereto, enabling determination of the efficiency of the person's body in using energy, for use in determining the person's physical condition.

The device includes a mechanism for enabling the person to be tested to manually maintain rotation of flywheel 10, against resistance applied thereto, and a mechanism for overcoming inertia of flywheel 10 from rest to the selected speed of rotation thereof non-manually, adapted to be selectively switched "on" and "off", as shown in FIG. 1. It further includes a device for resisting continuing rotation of flywheel 10, adapted to be selectively switched "on" and "off", and a device for enabling selective switching of the non-manual inertia overcoming mechanism and of the rotation resisting mechanism "on" and "off", not shown.

The manual rotation enabling mechanism includes a crankshaft 22, rotatably mounted in frame 20, at a location spaced from flywheel 10, which extends parallel to and transversely aligned with flywheel hub 18. Pedals 12 and 14 are rotatably mounted at the opposite ends of crankshaft 22 to enable cranking thereof.

A sprocket 24 of the manual rotation enabling mechanism is mounted on crankshaft 22 for rotation therewith. A hub 26, which includes a one-way clutch therein (not shown), is rotatably mounted in frame 20 intermediate crankshaft 22 and flywheel hub 18, is spaced from flywheel 10, and extends parallel to and is transversely aligned with crankshaft 22 and flywheel hub 18.

A sprocket 28 of the manual rotation enabling mechanism, the diameter of which is less than the diameter of sprocket 24, is mounted on hub 26 for rotation therewith. A chain 30 extends between sprockets 24 and 28, for transmitting rotation of sprocket 24 to sprocket 28.

A sprocket 32 of the manual rotation enabling mechanism, the diameter of which is greater than the diameter of sprocket 28, is mounted on hub 26 and ganged with sprocket 28 for rotation therewith.

A sprocket 34 of the manual rotation enabling mechanism, the diameter of which is less than the diameter of sprocket 32 and less than the diameter of flywheel 10, is mounted on flywheel hub 18. A belt 36 extends between sprockets 32 and 34, for transmitting rotation of sprocket 32 to sprocket 34 and rotation of sprocket 34 to sprocket 32. Flywheel 10 is ganged with sprocket 34 for rotation therewith.

The non-manual inertia overcoming mechanisim, in the embodiment shown in FIG. 1, includes a motor 38, selectively switchable "on" and "off", including a drive shaft 40 projecting therefrom and driven thereby, rotatably mounted in frame 20 at a location therein spaced from flywheel hub 18 and flywheel 10.

A sprocket 42 of the non-manual inertia overcoming mechanism, is mounted on drive shaft 40 for rotation therewith. A shaft 44 is rotatably mounted in frame 20 spaced from drive shaft 40 and from flywheel 10 and located proximate belt 36, and extends parallel to and is aligned transverely with drive shaft 40.

A sprocket 46 of the non-manual inertia overcoming mechanism, the diameter of which is equal to the diameter of sprocket 42, is mounted on shaft 44 for rotation therewith. Alternatively, the diameter of sprocket 42 may be less than the diameter of sprocket 46. A chain 48 extends between sprockets 42 and 46 for transmitting rotation of sprocket 42 to sprocket 46 and rotation of sprocket 46 to sprocket 42.

A sprocket 50 of the non-manual inertia overcoming mechanism, the diameter of which is greater than the diameter of sprocket 46, is mounted on shaft 44 and ganged with sprocket 46 for rotation therewith. Sprocket 50 is engaged with belt 36 for driving thereof.

In another embodiment, not shown, the non-manual inertia overcoming mechanism includes a motor, selectively switchable "on" and "off", including a drive shaft projecting therefrom and driven thereby. The drive shaft is rotatably mounted in the frame, and the flywheel is mounted on the drive shaft for rotation therewith. In such embodiment, the motor is further adapted to be reversibly switchable, such that upon switching thereof into "reverse", it applies resistance to continued rotation of the drive shaft and thereby to continued rotation of the flywheel mounted thereon, such that the motor comprises the rotation resisting device.

In operation of the embodiment shown in FIG. 1, upon turning motor 38 "on", drive shaft 40 rotates, as in the clockwise direction, generating corresponding clockwise rotation of flywheel 10.

Clockwise rotation of drive shaft 40 generates corresponding rotation of sprocket 42 mounted thereon, and, through chain 48 engaged therewith and with sprocket 46, generates corresponding rotation of sprockets 46 and 50 ganged therewith, and of shaft 44 on which sprockets 46 and 50 are mounted.

Clockwise rotation of sprocket 50, through belt 36 engaged therewith, generates corresponding rotation of sprockets 32 and 34. Since sprocket 32 is ganged together with sprocket 28 through the one-way clutch mounted on hub 26, it does not generate corresponding rotation thereof and of pedals 12 and 14, thereby preventing disturbance of the person to be tested prior to the onset of the test. Since flywheel 10 is ganged with sprocket 34 on flywheel hub 18, it generates corresponding rotation thereof.

Such operation of motor 38 thereby generates clockwise rotation of flywheel 10, to non-manually overcome inertia therein from rest to the selected speed of rotation thereof, prior to the onset of the test. Such non-manual rotation of flywheel 10 continues for a period of time, until the person is in a substantially steady-state condition, at which point the test is initiated, the non-manual inertia overcoming mechanism is switched "off", the rotation resisting device is switched "on", resistance is applied to flywheel 10, and the person being tested manually generates continuing rotation of flywheel 10 against the resistance applied thereto.

In operation of the other embodiment, described but not shown, in which the flywheel is mounted on the motor drive shaft for rotation therewith, upon turning the motor "on" the drive shaft rotates, rotating the flywheel and overcoming inertia therein from rest to the selected speed of rotation thereof non-manually, prior to the onset of the test. At the onset of the test, the switching device enables switching of the motor into "reverse", thereby switching "off" the drive of the flywheel by the motor drive shaft, and switching "on", through the motor, application of resistance to continued rotation of the flywheel. The person to be tested then generates continuing rotation of the flywheel by cranking the pedals, against resistance applied to the flywheel by the motor.

The non-manual inertia overcoming mechanism, in the embodiment shown in FIGS. 1 and 2, including motor 38, drive shaft 40, sprocket 42, chain 48, sprocket 46, shaft 44, and sprocket 50, and in the embodiment described but not shown, including the motor and drive shaft thereof, enables overcoming of inertia in flywheel 10 from rest to the selected speed of rotation thereof non-manually, in an efficient and effective manner, prior to the onset of the test, at which point the person being tested is to manually maintain continuing motion of flywheel 10 against resistance to be applied thereto.

Preferred embodiments of the invention have been set forth above, for the purpose of explaining the invention. However, it is to be understood that variations may be made in such embodiments, which variations are nevertheless within the scope and spirit of the invention, as set forth in the claims herein.

I claim:

1. An apparatus for enabling testing of a person's physical condition, by enabling measurement of energy expended by the person in manually maintaining rotation of a rotatable mass, against resistance applied thereto, in which the inertia of the mass from rest to a selected speed of rotation thereof is overcome non-manually prior to the onset of the test, comprising:

(a) means for rotatably mounting the mass;

(b) means for enabling the person to be tested to manually maintain rotation of the mass, against resistance applied thereto, by expending measurable energy in the operation thereof;

(c) means for overcoming inertia of the mass, from rest to the selected speed of rotation thereof, non-manually, adapted to be selectively switchable "on" and "off";

(d) means for resisting continuing rotation of the mass, adapted to be selectively switchable "on" and "off", comprising a motor, adapted to be switched into reverse to generate an output which resists manual rotation of the mass by the person whose energy output is to be measured; and (e) means for enabling switching of the non-manual inertia overcoming means "on" prior to the onset of the test, and for enabling switching of the non-manual inertia overcoming means "off" and switching of the rotation resisting means "on" at the onset of the test.

2. An apparatus for enabling testing of a person's physical condition, by enabling measurement of energy expended by the person in manually maintaining rotation of a rotatable mass, against resistance applied thereto, in which the inertia of the mass from rest to a selected speed of rotation thereof is overcome non-manually prior to the onset of the test, comprising:

(a) means for rotatably mounting the mass;

(b) means for enabling the person to be tested to manually maintain rotation of the mass, against resistance applied thereto, by expending measurable energy in the operation thereof;

(c) means for overcoming inertia of the mass, from rest to the selected speed of rotation for onset of the test, non-manually, adapted to be selectively switchable "on" and "off", and for resisting continuing rotation of the mass after onset of the test, adapted to be selectively switchable "on" and "off"; and (d) means for enabling switching of the non-manual inertia overcoming means "on" prior to the onset of the test, and for enabling switching of the non-manual inertia overcoming means "off" and switching of the rotation resisting means "on" at the onset of the test.

3. An apparatus as in claim 2, in which the non-manual inertia overcoming and resisting means comprise a motor, adapted to be switched into reverse such that resistance is applied thereby to manual rotation of the mass by the person whose energy output is to be measured.

4. An apparatus as in claim 2, in which the non-manual inertia overcoming means are further adapted to overcome initial friction and mechanical resistance in the apparatus, non-manually.

* * * * *